US007077682B2

(12) United States Patent
Ye et al.

(10) Patent No.: US 7,077,682 B2
(45) Date of Patent: Jul. 18, 2006

(54) ELECTRICAL CONNECTOR WITH STRENGTHENED ACTUATION DEVICE

(75) Inventors: Hui Ye, Kunsan (CN); HuaYin Huang, Kunsan (CN); JinMin Zeng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/851,009

(22) Filed: May 21, 2004

(65) Prior Publication Data

US 2004/0235330 A1 Nov. 25, 2004

(30) Foreign Application Priority Data

May 20, 2003 (TW) ..... 92209239 U

(51) Int. Cl.
*H01R 4/50* (2006.01)

(52) U.S. Cl. ..... 439/342

(58) Field of Classification Search ..... 439/264, 439/266, 268, 342
See application file for complete search history.

(56) References Cited

U.S. PATENT DOCUMENTS 3,495,132 A * 2/1970 Anhalt et al. ..... 361/801
6,340,309 B1 1/2002 Lin et al.
6,699,056 B1 * 3/2004 He et al. ..... 439/342
6,929,496 B1 * 8/2005 Ye et al. ..... 439/342

OTHER PUBLICATIONS

Peter Baker & Tim Hoyt, Development of ZIF BGA Socket, pp. 16-18, May 2000 Connector Specifier Journal.

* cited by examiner

*Primary Examiner*—Khiem Nguyen
(74) *Attorney, Agent, or Firm*—Wei Te Chung

(57) ABSTRACT

An electrical connector (1) is for electrically connecting an electronic package with a circuit substrate. The connector includes a base (10) with a locating slot (120) defined therein, a cover (13) slidably attached on the base, and an actuation device (14) assembled in the locating slot for actuating the cover to slide along the base. The actuation device includes a camshaft (140) and an operation lever (141). The camshaft includes a first supporting portions (1403) adjacent to the operation lever and a second supporting portion (1404). A gap exists between the first supporting portion and the locating slot. When the operation lever is accidentally over-rotated beyond a perpendicular position, the camshaft applies a force to the locating slot at the second supporting portion instead of the first supporting portion. This protects the locating slot from being destroyed.

18 Claims, 6 Drawing Sheets

ELECTRICAL CONNECTOR WITH STRENGTHENED ACTUATION DEVICE

BACKGROUND OF THE INVENTION

1. Field of the Invention

The present invention relates to an electrical connector for electrically connecting an electronic package such as a central processing unit (CPU) with a circuit substrate such as a printed circuit board (PCB), and particularly to an electrical connector with a strengthened actuation device that actuates connection and disconnection of the CPU with and from the electrical connector.

2. Description of Prior Art

Electrical connectors are widely used in personal computer (PC) systems for electrically connecting electronic packages such as CPUs with circuit substrates such as PCBs. Typical such electrical connectors are known as CPU sockets. A typical CPU socket comprises a base soldered and electrically connected with the PCB, a cover slidably attached on the base and having a CPU attached thereon, and an actuation device assembled between the base and the cover for actuating the cover to slide along the base.

The CPU has a multiplicity of pins depending from a bottom surface thereof and arranged in a rectangular array. The cover of the CPU socket has a multiplicity of through holes arranged in a rectangular array corresponding to the pins of the CPU. The base of the CPU socket has a multiplicity of passageways arranged in a rectangular array corresponding to the pins of the CPU. Each passageway receives an electrical terminal therein.

In use, the cover is at an open position with respect to the base. Then, the CPU is attached to the CPU socket. The pins of the CPU extend through the corresponding through holes of the cover and are received in the corresponding passageways of the base. The pins of the CPU do not contact corresponding electrical terminals. Thus the CPU is attached with zero insertion force. In particular, the pins of the CPU are prevented from being flexed by sudden force being applied thereto by the electrical terminals. Then, the actuation device actuates the cover to slide along the base. When the cover reaches a closed position with respect to the base, the actuation device pushes the pins of the CPU into mechanical and electrical engagement with the corresponding electrical terminals.

This kind of conventional CPU socket is detailed in "Development of ZIF BGA Socket" (pp 16~18, May 2000, Connector Specifier Journal). This kind of conventional CPU socket is also disclosed in U.S. Pat. No. 6,340,309.

FIG. 7 shows a conventional LGA connector 6 for electrically connecting a CPU (not shown) with a PCB (not shown). The connector 6 comprises a generally rectangular insulative base 60, a cover 61 slidably attached on the base 60, and an actuation device 62 assembled between the base 60 and the cover 61 for actuating the cover 61 to slide along the base 60.

The base 60 comprises a main portion 600, and a front portion 601 integrally extending from the main portion 600. The main portion 600 defines a multiplicity of receiving passageways 6000 arranged in a rectangular array. Each passageway 6000 receives an electrical terminal 63 therein, and the electrical terminals 63 are electrically connected with the PCB. The front portion 601 defines a locating slot therein and a pair of spaced windows 6013 at an outward side thereof. The front portion 601 forms a first and a second receiving portions 6011*a*, 6011*b* at respective opposite ends of the locating slot, and a central third receiving portion 6011*c* between the first and second receiving portions 6011*a*, 6011*b*. The third receiving portion 6011*c* defines a locating step 6012 thereon nearest the main portion 600. In view of the window 6013 adjacent to the first receiving portion 6011*a*, the first receiving portion 6011*a* is cantilever-shaped.

The cover 61 defines a multiplicity of through holes 610 arranged in a rectangular array corresponding to the receiving passageways 6000 of the base 60. The cover 61 further comprises a pair of locks 611 engaging in corresponding windows 6013 of the front portion 601 of the base 60.

The actuation device comprises a camshaft 620 and an operation lever 621 extends perpendicularly from one end of the camshaft 620. The camshaft 620 forms a first and a second supporting portions 6200*a*, 6200*b* at respective opposite ends thereof, and a central third supporting portion 6200*c* between the first and second supporting portions 6200*a*, 6200*b*. The first, second and third supporting portion 6200*a*, 6200*b*, 6200*c* are respectively rotatablely received in the first, second and third receiving portions 6011*a*, 6011*b*, 6011*c*. The third supporting portion 6200*c* defines a locating block 6201 thereon corresponding to the locating step 6012 of the third receiving portion 6011*c* of the base 60.

In use, the cover 61 is at an open position with respect to the base 60. At this position, the locating block 6201 of the camshaft 620 engages with the locating step 6012 of the third receiving portion 6011*c* of the base 60, thereby the operation lever 621 is positioned perpendicularly to the base 60. Then, the CPU is attached to the connector 6. The pins of the CPU extend through corresponding through holes 610 of the cover 61 and are received in corresponding passageways 6000 of the base 60. The pins of the CPU do not contact with corresponding electrical terminals 63. Thus, the CPU is attached with zero insertion force. Then, the actuation device 62 actuates the cover 61 to slide along the base 60. When the cover 61 reaches a closed position with respect to the base 60, the actuation device 62 pushes the pins of the CPU into mechanical and electrical engagement with corresponding electrical terminals 63. At this position, the operation lever 621 is parallel to the base 60.

When the CPU is attached on or removed from the connector 6, the operation lever 621 is rotated upwardly to a position perpendicular to the base 60. In this process, the operation lever is prone to be accidentally over-rotated beyond said perpendicular position. When this happens, the first supporting portion 6200*a* of the camshaft 620 applies a force to the locating slot 6010 at the first receiving portion 6011*a*. Because the first receiving portion 6011*a* is cantilever-shaped, a tension of the first receiving portion 6011*a* is reduced. When the force is applied on the first receiving portion 6011*a*, the first receiving portion 6011*a* is prone to be destroyed. This results in the locating slot 6010 being destroyed.

A new electrical connector that overcomes the above-mentioned disadvantages is desired.

SUMMARY OF THE INVENTION

Accordingly, an object of the present invention is to provide an electrical connector for electrically connecting an electronic package such as a CPU with a circuit substrate such as a PCB, the electrical connector having a strengthened actuation device for protect the connector from being destroyed.

To achieve the above-mentioned objects, an electrical connector in accordance with a preferred embodiment of the present invention is for electrically connecting a CPU with a PCB. The electrical connector comprises a generally rectangular insulative base, a cover slidably attached on the base, and an actuation device assembled between the cover and the base for actuating the cover to slide along the base.

The base has a locating slot defined therein. The actuation device comprises a camshaft and an operation lever. The camshaft is positioned between in the locating slot of the base, and the operation lever extends perpendicularly from one end of the camshaft. The operation lever is positioned substantially outside the base and the cover, to facilitate manual handling by a user. The camshaft comprises a first supporting portions adjacent to the operation lever, a second, a third and a fourth supporting portions in sequence. The first supporting portion comprises a first part and a second part. A radius of the first part is larger than that of the second part. The second part is received in the locating slot of the base, and a gap exists between the second part of the first supporting portion and the locating slot. During rotating the actuation device from a closed position to an open position, the operation lever is prone to be accidentally over-rotated beyond the perpendicular position. When this happens, the camshaft applies a force to the locating slot at the second supporting portion instead of the first supporting portion. This protects the locating slot from being destroyed.

Other objects, advantages and novel features of the present invention will become more apparent from the following detailed description when taken in conjunction with the accompanying drawings, in which:

DETAILED DESCRIPTION OF PREFERRED EMBODIMENT OF THE INVENTION

Reference will now be made to the drawings to describe the present invention in detail.

Figure 1:
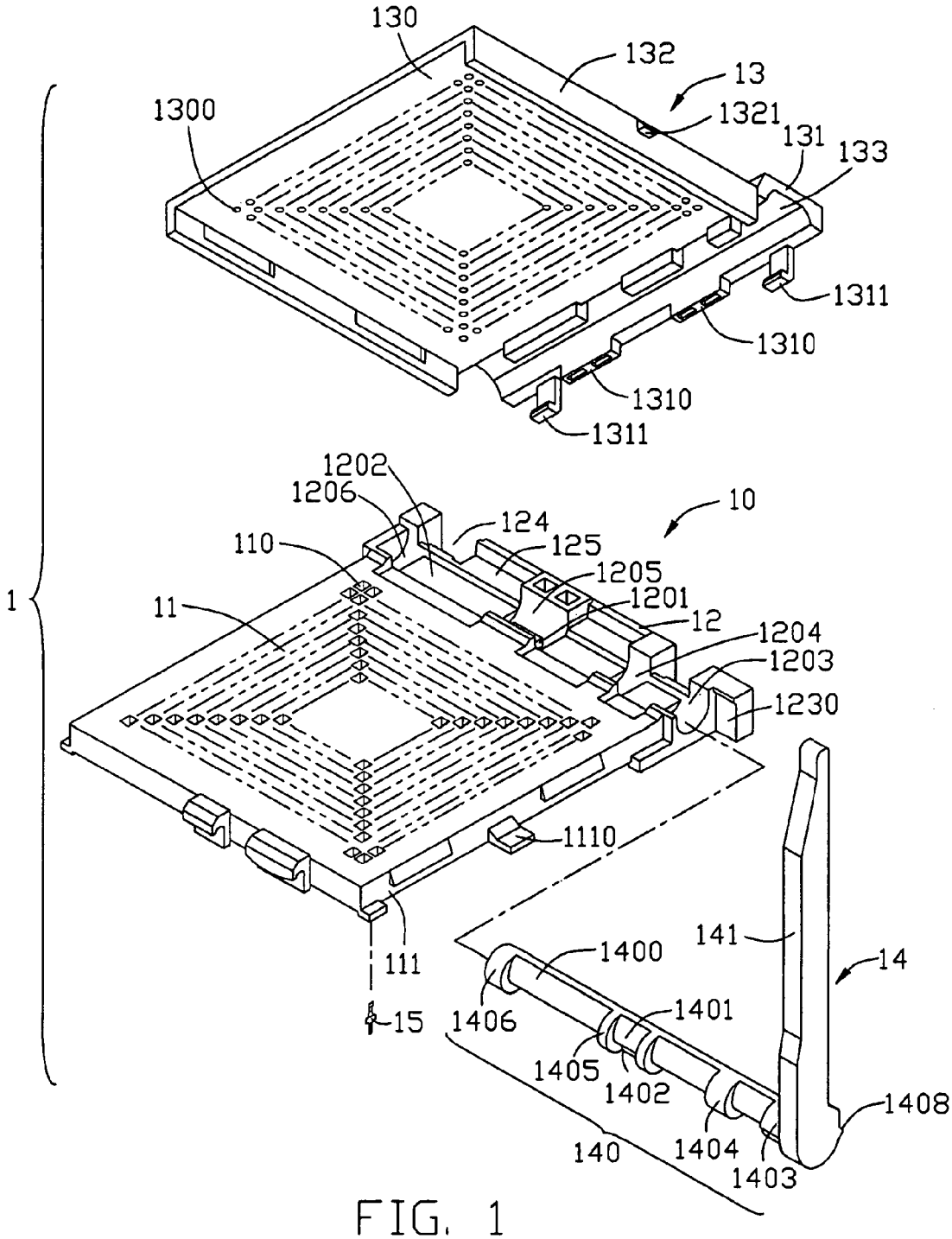
FIG. 1 is an exploded, isometric view of an electrical connector in accordance with a preferred embodiment of the present invention, the electrical connector comprising a cover, a base and an actuation device, the base and the actuation device being viewed from one aspect, and the cover being viewed from another aspect.

FIG. 1 is an exploded, isometric view of an electrical connector 1 in accordance with a preferred embodiment of the present invention. The electrical connector 1 is for electrically connecting a CPU (not shown) to a PCB (not shown). The electrical connector 1 comprises a generally rectangular insulative base 10, a cover 13 slidably attached on the base 10, and an actuation device 14 positioned between the base 10 and the cover 13 for actuating the cover 13 to slide along the base 10.

The base 10 comprises a main portion 11 and a front portion 12 integrally extending from the main portion 11. The main portion 11 defines a multiplicity of receiving passageways 110 arranged in a rectangular array. Each passageway 110 receives an electrical terminal 15 therein, and the electrical terminals 15 are electrically connected with the PCB. The main portion 11 further defines a block 1110 at a side wall 111 thereof. The front portion 12 defines a longitudinal locating slot therein. The front portion 12 forms a first and fourth receiving portions 1203, 1206 at opposite ends of the locating slot 120. The front portion 12 further forms a second and third receiving portions 1204, 1205 in sequence at the locating slot 120 between the first and fourth receiving portions 1203, 1206. The first, second, third and fourth receiving portion 1203, 1204, 1205 and 1206 are semi-columnar. The third receiving portion 1205 forms a locating step 1201 at a side thereof distal from the main portion 11. A plurality of locating portions 1202 are respectively formed between the first and second receiving portions 1203, 1204, the second and third receiving portion 1204, 1205, and the third and fourth receiving portions 1205, 1206.

The front portion 12 further defines a pair of spaced windows 124 at an outward side thereof. One of the spaced windows 124 is formed between the first and second receiving portions 1203, 1204. Thus, the first receiving portion 1203 is cantilever-shaped. The front portion 12 further forms a pair of receiving rooms 125 between the second and third receiving portions 1204, 1205, and the third and fourth receiving portions 1205, 1206. The receiving rooms 125 are parallel to the locating slot 12. The front portion 12 outwardly forms a retaining block 1230 from one end thereof having the first receiving portion 1203.

The cover 13 comprises a mating portion 130 corresponding to the main portion 11 of the base 10, and a head portion 131 corresponding to the front portion 12 of the base 10. The mating portion 130 defines a multiplicity of through holes 1300 arranged in a rectangular array corresponding to the receiving passageways 110 of the base 10. The mating portion 130 further defines a protrusion 1321 at a side wall 132 thereof. The protrusion 1321 engages with the block 1110 of the base 10. The head portion 131 defines a longitudinal receiving slot 133 corresponding to the locating slot of the base 10. The receiving slot 133 and the locating slot cooperatively define a receiving space. The head portion 131 further comprises a pair of locating blocks 1310 and a pair of clasps 1311. The locating blocks 1310 are received in corresponding receiving rooms 125 of the base 10. The clasps 1311 engage in corresponding windows 124 of the base 10.

Figure 2:
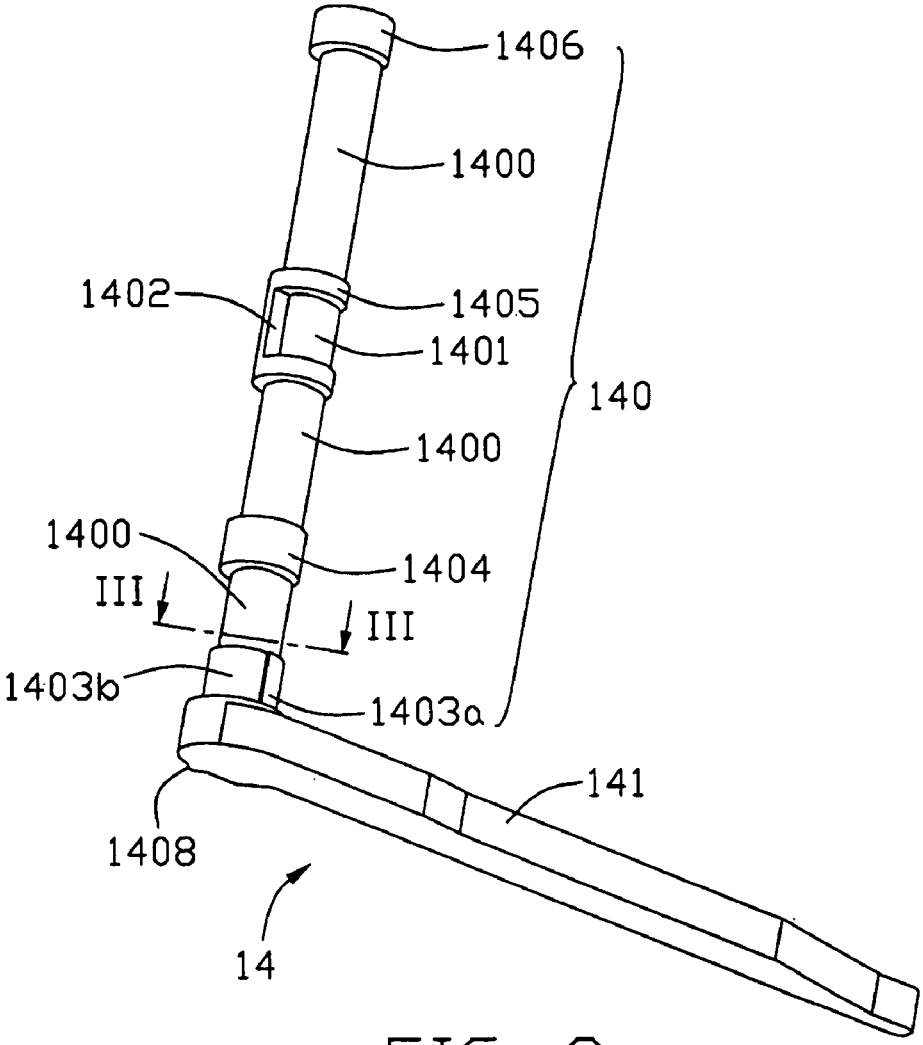
FIG. 2 is an enlarged view of the actuation device of FIG. 1, but viewed from another aspect.
Figure 3:
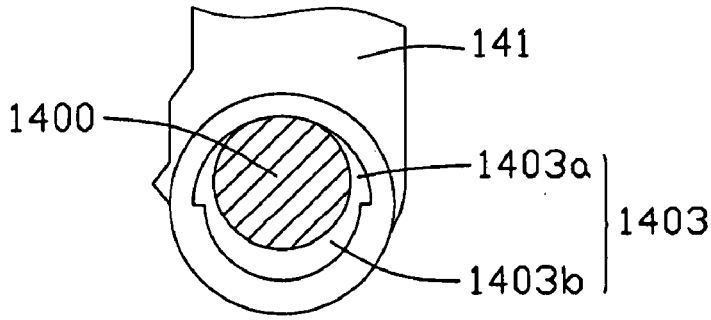
FIG. 3 is an enlarged, cross-sectional view of the actuation device of FIG. 2, taken along line III—III of FIG. 2.

FIG. 2 shows the actuation device 14 of the connector 1. FIG. 3 is an enlarged, cross-sectional view of the actuation device of FIG. 2, taken along line III—III of FIG. 2. The actuation device 14 comprises a camshaft 140 positioned in the receiving space formed by the base 10 and the cover 13, and an operation lever 141. The operation lever 141 extends perpendicularly from one end of the camshaft 140, and is positioned substantially outside the base 10 and the cover 13 to facilitate manual handling by a user. The camshaft 140 comprises a first and fourth supporting portions 1403, 1406 at opposite ends thereof, a second and third supporting portions 1404, 1405 in sequence between the first and fourth supporting portion 1403, 1406. The first, second, third and fourth supporting portions 1403, 1404, 1405, 1406 are columnar and respectively rotatablely received in the first, second, third and fourth receiving portions 1203, 1204, 1205, 1206 of the base 10. The first supporting portion 1403 is adjacent to the operation lever 141 and comprises a semi-columnar first and a semi-columnar second parts 1403*a*, 1403*b*. A radius of the first part 1403*a* is larger than that of the second part 1403*b*. The second part 1403*b* is received in first receiving portion 1203 of the base 10, and a gap exists between the second part 1403*b* of the first supporting portion 1403 and the first receiving portion 1203 of the base 10. The third supporting portion 1405 comprises an arched actuating surface 1401, and a flat locating surface 1402. The camshaft 140 further defines a plurality of actuating portions 1400 between the first and second supporting portions 1403, 1404, the second and third supporting portions 1404, 1405, and the third and fourth supporting portions 1405, 1406. A rotation axis of every actuating portion 1400 is offset from that of every supporting portion. The operation lever 141 has an opening 1410 defined therein (shown in FIG. 5). The opening 1410 is corresponding to the protrusion 1321 of the cover 13. A protrusion 1408 is formed on a proximal end of the operation lever 141.

Figure 4:
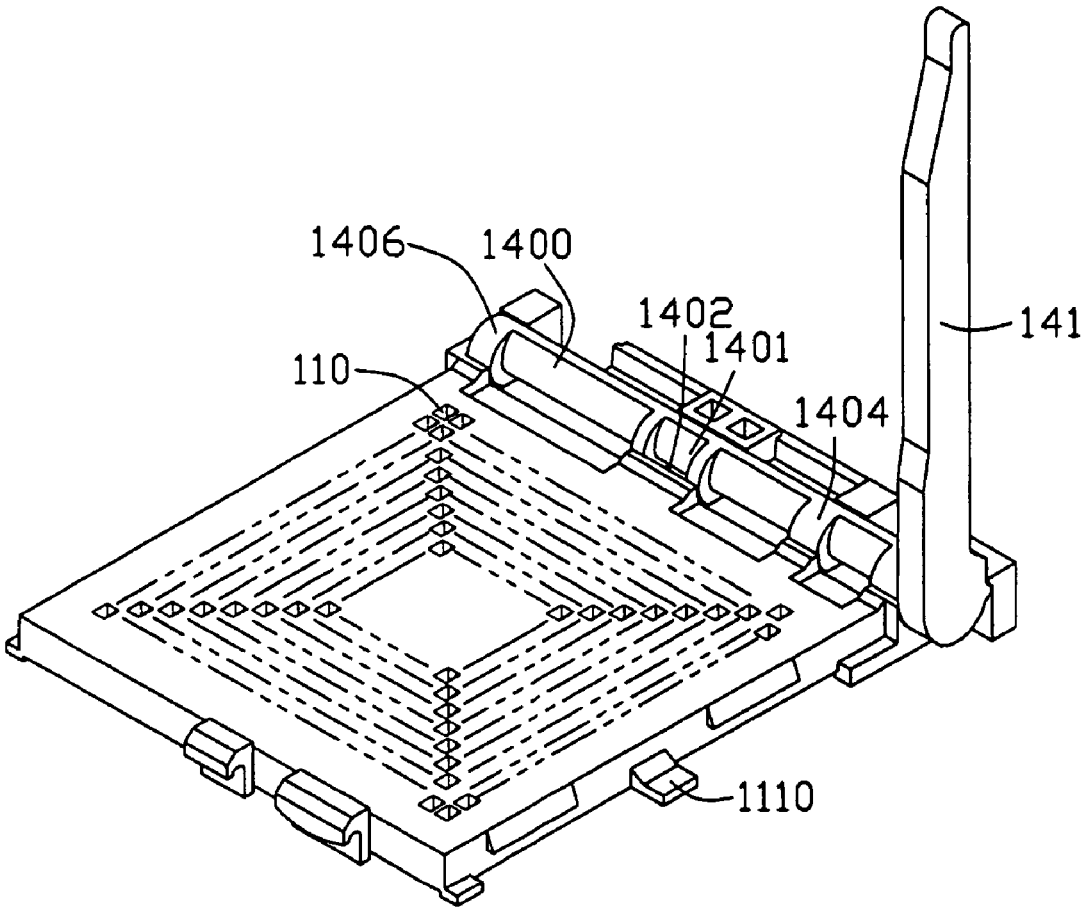
FIG. 4 is a partly assembled view of FIG. 1, showing the actuation device rotatably received in the base with an operation lever of the actuation device being perpendicular to the base.
Figure 5:
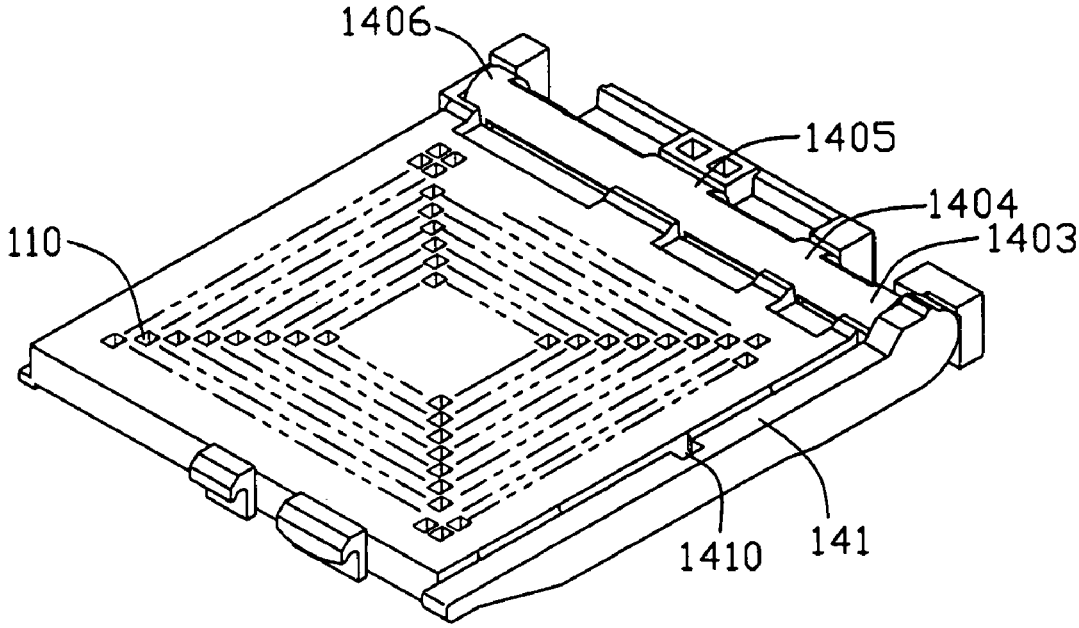
FIG. 5 is similar to FIG. 4, but showing the operation lever of the actuation device being parallel to the base.
Figure 6:
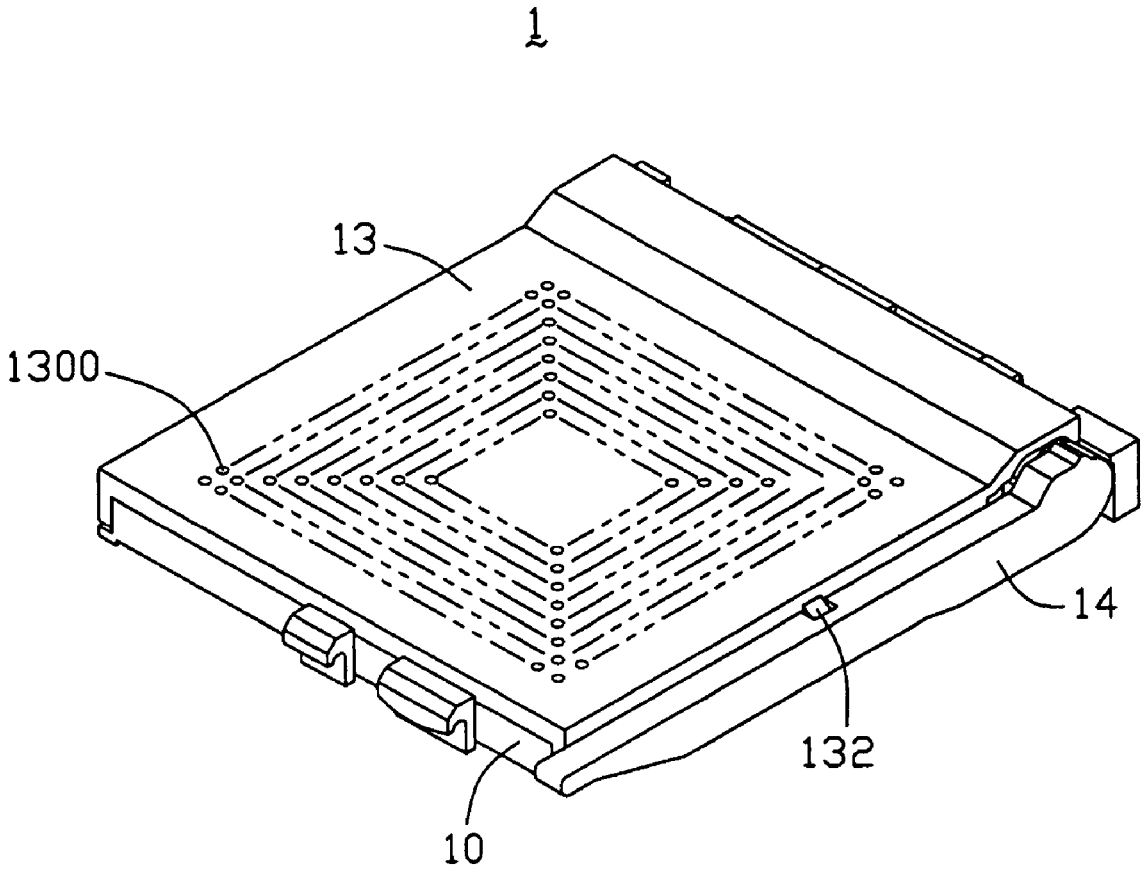
FIG. 6 is fully assembled view of FIG. 1, showing the operation lever of the actuation device being parallel to the base.
Figure 7:
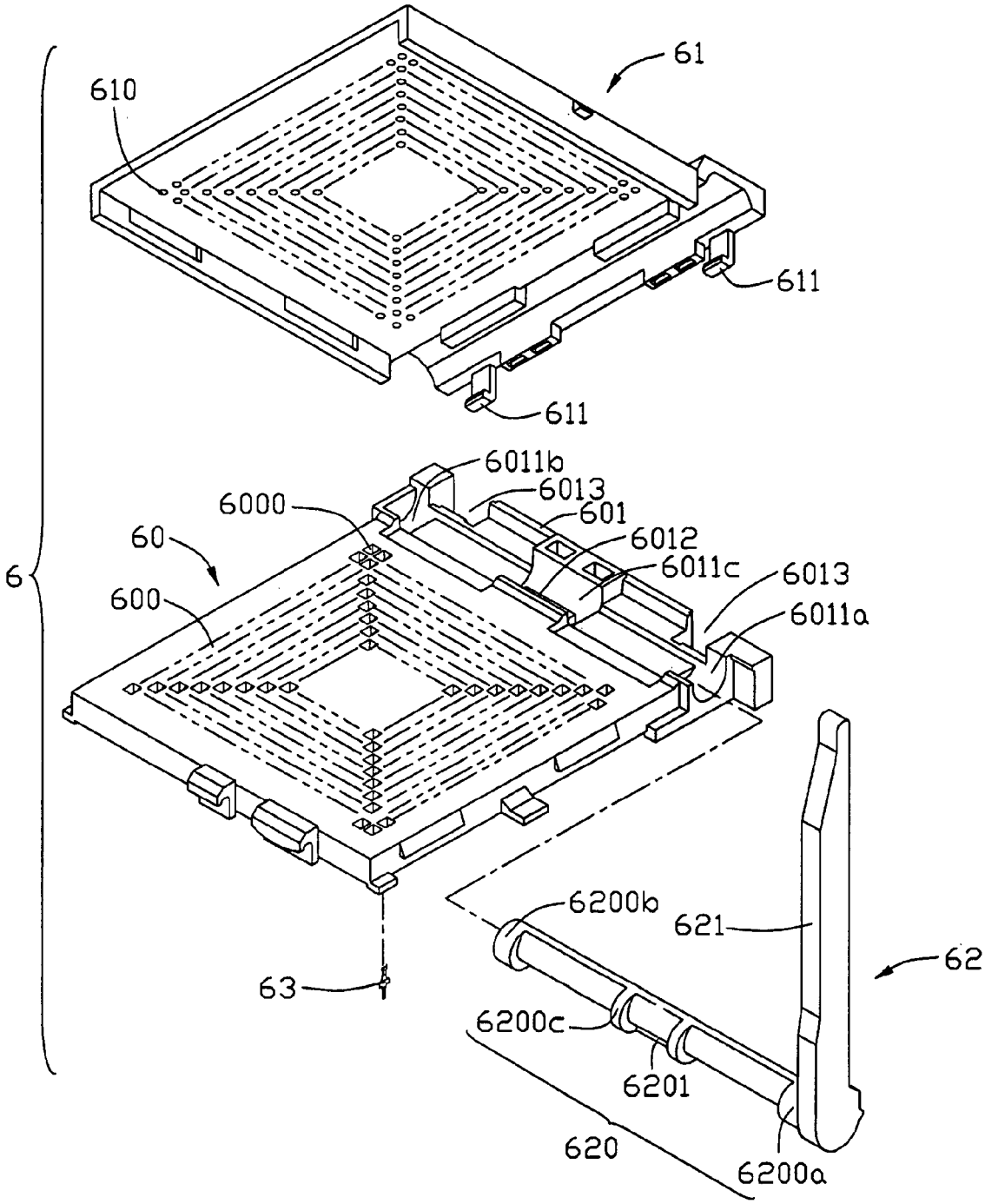
FIG. 7 (PRIOR ART)
FIG. 7 is an exploded, isometric view of a conventional electrical connector, the electrical connector comprising a cover, a base and an actuation device, the base and the actuation device being viewed from one aspect, and the cover being viewed from another aspect.

FIG. 4 shows the actuation device 14 rotatably received in the base 10 with the operation lever 141 of the actuation device 14 being perpendicular to the base 10, and FIG. 5 shows the operation lever 141 of the actuation device 14 being parallel to the base 10.

When the operation lever 141 of the actuation device 14 is rotated to the position perpendicular to the base 10, the CPU is attached on the cover 13, and the pins of the CPU extend through the through holes 1300 of the cover 13 and into the corresponding receiving passageways 110 of the base 10 without contacting with corresponding electrical terminals 15 of the base 10. At this position, the locating surface 1402 of the third supporting portion 1405 of the camshaft 140 engages with the locating step 1201 of the third receiving 1205 of the base 10. The protrusion 1408 of the operation lever 141 engages with the retaining block 1230 of the base 10. This helps retain the operation lever 141 at said perpendicular position. When the operation lever 141 is rotated down from said perpendicular position to the position parallel to and alongside the base 10, the actuation device 14 pushes the cover 13 to slide along the base 10 in a rearward direction. This results in the pins of the CPU mechanically and electrically connecting with the corresponding electrical terminals 15. This process is defined as a closing process. At the parallel position, the protrusion 1321 on the side wall 132 of the cover 13 engages in the opening 1410 of the operation lever 141. This helps retain the operation lever 141 at said parallel position.

When the operation lever 141 is rotated from said parallel position to said perpendicular position, the actuation device 14 pushes the cover 13 to slide along the base 10 in a forward direction. This results in the pins of the CPU mechanically and electrically disconnecting from the corresponding electrical terminals 15. This process is defined as an opening process.

During rotating the actuation device 14 from the closed position to the open position, the operation lever 141 is prone to be accidentally over-rotated beyond the perpendicular position. The force put on the operation lever 141 produces a twisting moment on the camshaft 140 from the locating surface 1402 to the first supporting portion 1403. The twisting moment causes the camshaft 140 continues to rotate in the locating slot 120, and the second supporting portion 1404 applies a force on the second receiving portion 1204 at the locating slot 120. In view of the gap existing between the first supporting portion 1403 and the cantilever-shaped first receiving portion 1203, the first supporting portion 1403 do not contact with the cantilever-shaped first receiving portion 1203, thereby applies no force on the cantilever-shaped first receiving part 1203 during rotating. The second receiving portion 1204 is not cantilever-shaped, and a tension of the second receiving portion 1204 is increased. Thus, when the force is applied on the second receiving portion 1204, the second receiving portion 1204 is protected form being destroyed. This protects the locating slot 120 from being destroyed.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting an electronic package with a circuit substrate, the electrical connector comprising:

a base receiving a plurality of electrical terminals therein, a locating slot being defined in one end of the base;

a cover slidably attached on the base; and an actuation device comprising a camshaft movably positioned between the base and the cover;

wherein the camshaft comprises a first and a second supporting portions, and a gap exists between the first supporting portion and the base at the locating slot;

wherein the fist supporting portion of the camshaft comprises a semi-columnar first and a semi-columnar second parts, a radius of the first part is larger than that of the second part, and the second part is accommodated in the locating slot.

2. The electrical connector as claimed in claim 1, wherein the camshaft further comprises a third supporting portion.

3. The electrical connector as claimed in claim 2, wherein the third supporting portion of the camshaft comprises an arched actuating surface and a flat locating surface.

4. The electrical connector as claimed in claim 3, wherein a plurality of actuating portions is defined between every two adjacent supporting portions, and a rotation axis of every actuating portion is offset from that of every supporting portion.

5. The electrical connector as claimed in claim 4, wherein the base forms a semi-columnar first, a semi-columnar second and a semi-columnar third receiving portions at the locating slot, corresponding to the first, second and third supporting portions of the camshaft.

6. The electrical connector as claimed in claim 5, wherein the third receiving portion defines a locating step thereon, corresponding to the actuating surface and the locating surface of the third supporting portion.

7. The electrical connector as claimed in claim 6, wherein a plurality of locating portions is defined between every two adjacent receiving portions.

8. The electrical connector as claimed in claim 7, wherein the base further defines a pair of spaced windows at an outward side thereof, and one window is formed between the first and the second receiving portions.

9. The electrical connector as claimed in claim 8, wherein the cover defines a receiving slot corresponding to the locating slot of the base, and a pair of clasps engage in corresponding windows of the base.

10. An electrical connector for electrically connecting an electronic package with a circuit substrate, the electrical connector comprising:

a base comprising a front portion defining a locating slot and a main portion receiving a plurality of electrical terminals;

a cover slidably attached on the base and defining a receiving slot corresponding to the locating slot of the base, the receiving slot and the locating slot cooperatively defining a receiving space; and an actuation device iompdsing a camshaft rotatably received in the receiving space, and an operation lever extending substantially perpendicularly from one end of the camshaft;

wherein the camshaft defines a first supporting portion at one end thereof adjacent to the operation lever, and a second supporting portion, the first supporting portion comprising two semi-columnar parts with different radiuses, one part having a smaller radius and being accommodated in the locating slot of the base to define a gap therebetween.

11. The electrical connector as claimed in claim 10, wherein the camshaft further comprises a third supporting portion.

12. The electrical connector as claimed in claim 11, wherein the third supporting portion of the camshaft comprises an arched actuating surface, and a flat locating surface.

13. The electrical connector as claimed in claim 12, wherein a plurality of actuating portions is defined between every two adjacent supporting portions, and a rotation axis of every actuating portion is offset from that of every supporting portion.

14. The electrical connector as claimed in claim 13, wherein the base forms a semi-columnar first, second and third receiving portions at the locating slot for accommodating the first, second and third supporting portions of the camshaft.

15. The electrical connector as claimed in claim 14, wherein the third receiving portion defines a locating step thereon, corresponding to the actuating surface and the locating surface of the third supporting portion.

16. The electrical connector as claimed in claim 15, wherein a plurality of locating portions is defined between every two adjacent receiving portions.

17. The electrical connector as claimed in claim 16, wherein the base further defines a pair of spaced windows at an outward side thereof, and one window is formed between the first and the second receiving portions.

18. The electrical connector as claimed in claim 17, wherein the base forms a retaining block from one end thereof, corresponding to a protrusion formed on the operation lever.

* * * * *